United States Patent [19]

Reid

[11] Patent Number: 4,976,110

[45] Date of Patent: Dec. 11, 1990

[54] SUPPORT SYSTEM FOR VACUUM INSULATED CYLINDRICAL CRYOGENIC VESSELS

[75] Inventor: Roy C. Reid, Calgary, Canada

[73] Assignee: Altank Industries Ltd., Calgary, Canada

[21] Appl. No.: 334,576

[22] Filed: Apr. 7, 1989

[30] Foreign Application Priority Data

Apr. 3, 1989 [CA] Canada ..... 595563

[51] Int. Cl.[5] ..... F17C 1/00

[52] U.S. Cl. ..... 62/45.1; 220/442

[58] Field of Search ..... 62/45.1; 220/442, 445, 220/448

[56] References Cited

U.S. PATENT DOCUMENTS

| | | | |
|---|---|---|---|
| 1,927,255 | 9/1933 | Brown | 220/442 |
| 3,147,878 | 9/1964 | Wissmiller | 220/445 |
| 3,295,327 | 1/1967 | Waterman | 220/445 |
| 3,428,013 | 2/1969 | Prew | 220/445 |
| 3,481,505 | 12/1969 | Nason et al. | 220/445 |
| 4,496,073 | 1/1985 | Silver et al. | 62/45.1 |

*Primary Examiner*—Ronald C. Capossela

*Attorney, Agent, or Firm*—Murray E. Thrift; Stanley G. Ade; Adrian D. Battison

[57] ABSTRACT

A cryogenic vessel includes an inner product container and an outer jacket surrounding the inner product container with an insulating space between them. Two supports are provided to support the inner product container within the outer jacket. Each support is an annularly corrugated sheet of material extending radially between the product container and the jacket.

18 Claims, 2 Drawing Sheets

SUPPORT SYSTEM FOR VACUUM INSULATED CYLINDRICAL CRYOGENIC VESSELS

FIELD OF THE INVENTION

The present invention relates to cryogenic vessels and more particularly to support systems for supporting an inner product container in the outer jacket of a double wall cryogenic vessel.

BACKGROUND

A cryogenic vessel is a container for fluids at very low temperatures. A typical cryogenic vessel is a double-walled vessel with an inner product container and an outer jacket, with the space between the container and the jacket evacuated and possibly containing thermally insulating and reflective materials.

One significant source of heat leakage into the product container from the outside can be the mechanical support system for supporting the product container within the outer jacket. While support systems are designed to provide minimum heat transfer, there are various mechanical factors that influence the design of the supports, as well, which often are at variance with the desired thermal characteristics.

The structural interrelationship between a support and the product container must reflect the fact that the product container walls are designed to be the thinnest allowable by the applicable pressure vessel codes. This is dictated by the high cost of materials suitable for use in a cryogenic environment and the need to minimize the thermal mass of the product container to avoid excessive cool down losses.

Another factor that must be taken into account is the fact that most metals will undergo a significant thermal shrinkage when cooled from shop fabricating temperatures in the order of 70° F. (21° C.) to super low cryogenic temperatures. The support systems generally incorporate a minimum of two individual components, one located near the service piping end of the vessel to anchor that end of the product container to the outer jacket to minimize piping strains from thermal movements. The other component is located towards the opposite end to allow free linear motion of the product container relative to the outer jacket. The design of the vessel supports must also accommodate radial shrinkage of the product container, while maintaining concentricity of the product container within the outer jacket, and at all times maintaining a solid, vibration free connection between the product container and the outer jacket.

The support system for the product container must also support the dead load of the laden product container. Cryogenic liquids have a specific gravity approaching that water. Thus, a 10,000 gallon (approximately 45,000 litre) vessel of cryogenic liquid might well approach 100,000 pounds (approximately 45,000 kilo-grams) of liquid lading.

Support materials in contact with the cryogenic vessel must necessarily be limited to those with suitable low temperature ductility properties. These include, for example, high nickel steel, some grades of stainless steel, aluminum, copper and some grades of bronze. Some synthetic materials, for example phenolics, teflon, nylon, etc., are usable in compression, but generally not in tension. Materials suitable for use in this environment are referred to herein as cryogenically acceptable materials.

Thermal mass is another important consideration in the design of a cryogenic vessel support system. However, minimizing the stress levels and providing adequately for thermal motion requires the maximizing of load bearing distribution areas in order to minimize load concentrations. This is contrary to the objective of minimum thermal mass, and a reasonable balance must be struck between the two requirements in a satisfactory design.

Since the maximum strength of a cylindrical vessel is attained at the head and shell juncture, supporting the heads will support the vessel if the vessel length is sufficiently short. If the vessel becomes too long, the compressive loads on the top of the cylindrical side wall will cause that part of the vessel wall to buckle. Consequently, some cryogenic vessels will require support between the heads of the product container shell and load distribution on the relatively thin shell becomes a major design consideration.

With the foregoing design criteria in mind, the present invention aims at the provision of a novel support for supporting a product container within an outer jacket of a cryogenic vessel.

SUMMARY

According to one aspect of the present invention there is provided, in a cryogenic vessel having a product container and an outer jacket surrounding the product container with an insulating space therebetween, a support for supporting the product container in the outer jacket, said support comprising:

- an annular sheet of cryogenically acceptable material with a plurality of annular corrugations therein;
- outer support means supporting the outer jacket on an outer edge of the sheet; and
- inner support means supporting the product container on an inner edge of the sheet.

According to another aspect of the present invention there is provided a cryogenic vessel comprising:

- a product container;
- an outer jacket surrounding the product container with an insulating space therebetween;
- first and second supports supporting the product container within the outer jacket, each said support comprising an annular sheet of cryogenically acceptable material formed into a plurality of annular corrugations, an outer support means supporting the outer jacket on an outer edge of the annular sheet and an inner support means supporting the product container on an inner edge of the annular sheet.

In the preferred embodiments of the invention, the product container and the outer jacket are cylindrical vessels, with the first support anchoring the two together at the end near the service piping, while the second support provides for longitudinal movement of the product container within the outer jacket.

The support means preferably include containment rings thermally bonded to the inner and outer edges of the corrugated sheet and in uniform, unbroken thermal contact with the product container and the outer jacket respectively. This arrangement provides a uniform temperature gradient across the support in any direction. The corrugated sheet provides a long temperature path of small cross section to maximize the resistance to heat transfer. At the same time, the annular corrugations serve to distribute radial and longitudinal loadings uniformly about the product container while maintaining the product container and outer jacket in a concentric relationship. The annularlY corrugated configuration of the sheet provides the sheet with a compact longitudinal dimension so that eccentric loadings between the inner product container and the outer jacket are eliminated.

BRIEF DESCRIPTION OF THE DRAWINGS

In the accompanying drawings, which illustrate an exemplary embodiment of the present invention.

DETAILED DESCRIPTION

Figure 1:
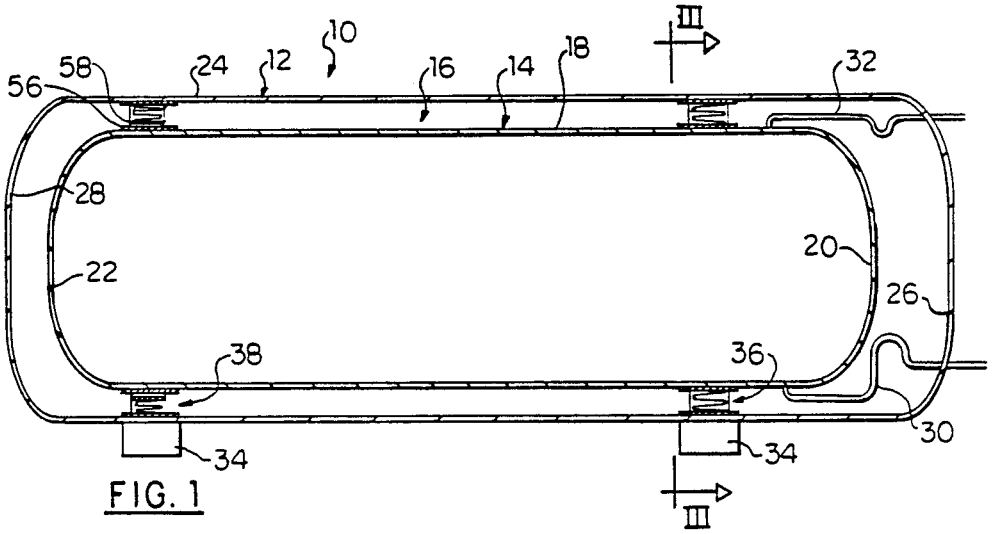
FIG. 1 is a cross-sectional view of a cryogenic vessel.

Referring to the accompanying drawings, and especially to FIG. 1, there is illustrated a cryogenic vessel 10 consisting of an outer jacket 12 housing an inner product container 14 with an evacuated insulating space 16 between them. The inner product container has a cylindrical side wall 18 joined at its ends to domed heads 20 and 22. The outer jacket 12 likewise has a cylindrical wall 24 closed at its ends with domed heads 26 and 28. The inner produce container and outer jacket are concentric about a common axis X-X. The service piping 30 and the vent 32 for the product container 14 are connected to the product container adjacent the head 20 and pass through the insulating space 16 and the head 26 of the outer jacket.

The cylindrical wall 24 of the outer jacket 12 is supported on two external supports 34. Opposite the supports, inside the insulating space 16 are product container supports 36 and 38. Loads are thus transmitted between the external supports 34 and the supports 36 and 38 without applying bending moments or shearing forces on the outer jacket 12.

Figure 2:
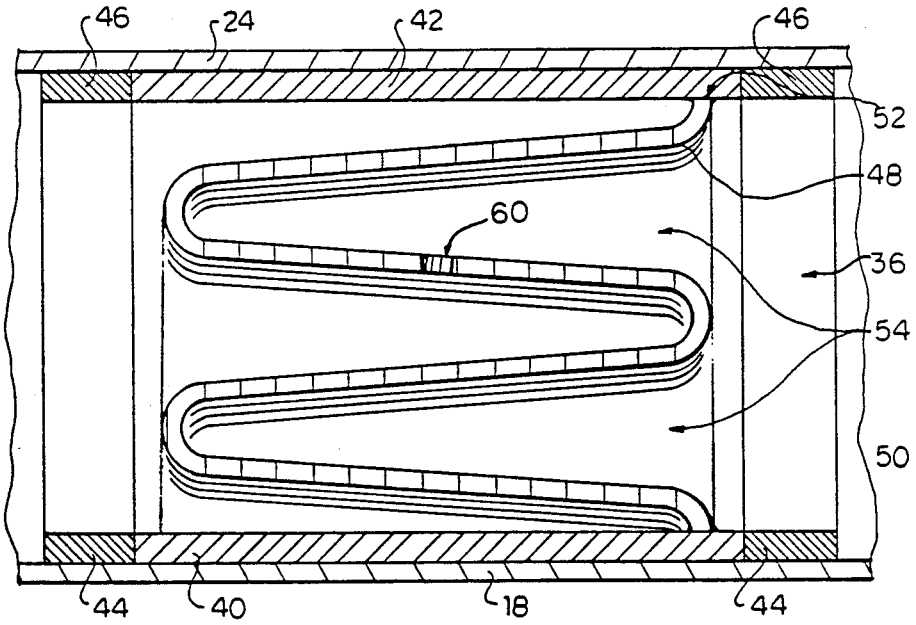
FIG. 2 is a detail of FIG. 1 showing the construction of a support.
Figure 3:
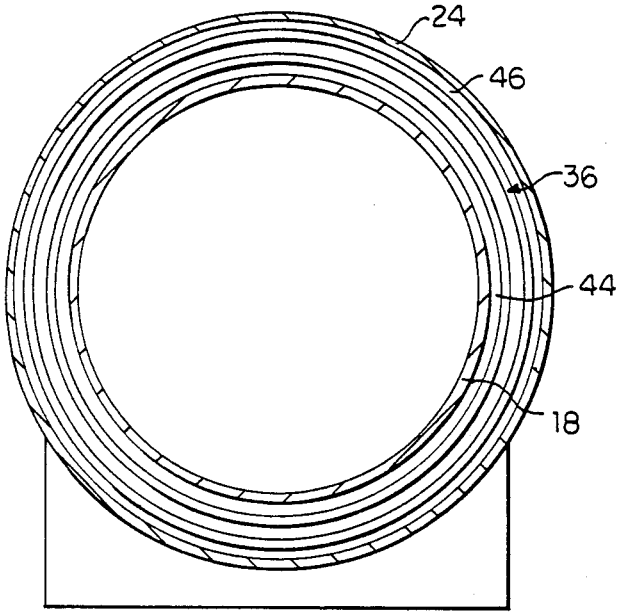
FIG. 3 is a section on line III-III of FIG. 1.

As illustrated most particularly in FIG. 2, the support 36 for the product container adjacent the heads 20 and 26, where the service piping and vent are located, includes an inner containment ring 40 that is seated on the outer surface of the cylindrical wall 18 of the inner product container 14. The heat transfer between the wall 18 and the containment ring 40 is uniform around the circumference of the ring.

The support 36 also includes an outer containment ring 42 that is seated on the inner surface of the cylindrical wall 24 of the outer jacket 12. Containment ring 42 is in uniform heat transfer relation with the wall 24 throughout the circumference of the ring. The inner ring 40 is prevented from moving longitudinally on the product container 14 with a pair of annular stops 44, while the outer containment ring 42 is likewise prevented from moving along the wall 24 by a pair of annular stops 46.

The two containment rings 40 and 42 are joined by an annular sheet 48 with an inner edge 50 thermally bonded to the containment ring 42 and an outer edge 52 thermally bonded to the containment ring 40. The sheet is formed into a series of annular corrugations 54 concentric with the sheet edges 50 and 52, the containment rings 40 and 42 and the cylindrical walls 18 and 24 of the container and jacket. A median plane Y-Y through the corrugations is perpendicular to the axis X-X.

The support 38 has generally the same construction as the support 36 but, in this case, the inner containment ring 40 is omitted and a bearing ring 56 is secured to the outer surface of the wall 18 of the product container. The inner edge 50 of the corrugated sheet 48 is thermally bonded to a slide ring supported on the bearing ring 56 to allow the bearing ring to slide longitudinally within the slide ring with thermally induced expansion or contraction of the product container 14. A median plane Z-Z of the corrugations in the support is perpendicular to the axis X-X.

Each of the sheets 48 is provided with one more vent ports 60 for communication of the vacuum on one side of the sheet with that on the other.

The annularly corrugated sheet 48 provides a 360° support for the product container within the outer jacket. A loading from any direction, causing a deflection of the corrugated support, will cause a compression on one side of the support ring and an expansion on the other. Both deflections will contribute to restoring the concentricity of the product container within the outer jacket. The relatively thin wall of the sheet from which the support ring is made, and the long path, following the corrugations, from the product container wall to the outer jacket, minimizes the heat loss through the support. The use of containment rings and the bearing ring at the expansion end of the product container, minimizes load concentrations on both the product container and the outer jacket. The loads are distributed uniformly around the container and jacket, regardless of whether they are thermally induced or caused by accelerations of the vessel. The corrugated support rings also anchor the product container longitudinally.

The corrugated support rings are sufficiently flexible that thermally induced changes in the diameter of the inner product container will be followed by the containment and bearing rings and ultimately the inner edge of the support ring. The short longitudinal dimension of the support and its radial orientation avoid the application of bending moments on the product container and the outer jacket in the transfer of loadings between the product container and the jacket.

While one embodiment of the present invention has been described in the foregoing, it is to be understood that other embodiments are possible within the scope of the invention. Thus, while specific reference has been made to a cryogenic vessel with an elongate cylindrical form, the invention is also applicable to vessels of other forms where the characteristic properties of the supports are useful. The invention is therefore to be considered limited solely by the scope of the appended claims.

I claim:

1. In a cryogenic vessel having a product container and an outer jacket surrounding the product container with an insulating space therebetween, the product container and the jacket being concentric about a common axis, a support for supporting the product container in the outer jacket, said support comprising:

an annular sheet of cryogenically acceptable material with a plurality of annular corrugations therein a median plane through the corrugations being perpendicular to the axis;

outer support means supporting the outer jacket on an outer edge of the sheet; and inner support means supporting the product container on an inner edge of the sheet.

2. A vessel according to claim 1 wherein the outer support means comprises an outer containment ring extending around an inner annular surface of the outer jacket.

3. A vessel according to claim 2 wherein the inner support means comprises an inner containment ring extending around an outer annular surface of the product container.

4. A vessel according to claim 3 including stops secured to the inner surface of the outer jacket and engaging opposite end faces of the outer containment ring.

5. A vessel according to claim 4 including stops secured to the outer surface of the product container and engaging opposite end faces of the inner containment ring.

6. A vessel according to claim 3 wherein the outer containment ring has an outer surface in substantially uniform heat transfer relationship with the inner surface of the outer jacket.

7. A vessel according to claim 6 wherein the inner containment ring has an inner surface in substantially uniform heat transfer relationship with the outer surface of the product container.

8. A vessel according to claim 7 wherein the inner and outer edges of the annular sheet are concentric with the annular corrugations and the containment rings.

9. A vessel according to claim 1 including at least one vent port through the sheet.

10. A cryogenic vessel comprising:

a product container concentric about an axis;

an outer jacket concentric about said axis and surrounding the product container with an insulating space therebetween;

first and second supports supporting the product container within the outer jacket, each said support comprising an annular sheet of cryogenically acceptable material formed into a plurality of annular corrugations, with a median plane through the corrugations being perpendicular to said axis, an outer support means supporting the outer jacket on an outer edge of the annular sheet and an inner support means supporting the product container on an inner edge of the annular sheet.

11. A vessel according to claim 10 wherein the outer jacket and the product container have concentric cylindrical walls and the first and second supports extend between the cylindrical walls.

12. A vessel according to claim 11 wherein each outer support means comprises an outer containment ring extending around an inner surface of the cylindrical wall of the outer jacket.

13. A vessel according to claim 12 wherein the inner support means of the first support comprise an inner containment ring extending around an outer surface of the cylindrical wall of the product container.

14. A vessel according to claim 13 wherein the inner support means of the second support comprise a bearing ring extending around and secured to the outer surface of the cylindrical wall of the product container and a slide ring secured to the inner edge of the sheet and fitted slideably onto the bearing ring to allow relative axial movement of the bearing ring in the slide ring.

15. A vessel according to claim 14 wherein each outer containment ring is in substantially uniform heat transfer relationships with the inner surface of the outer jacket.

16. A vessel according to claim 15 wherein the inner containment ring is in substantially uniform heat transfer relationship with the outer surface of the product container.

17. A vessel according to claim 16 wherein the bearing ring and slide ring provide a substantially uniform heat transfer relationship between the outer surface of the cylindrical wall of the product container and the inner edge of the sheet.

18. A vessel according to claim 17 wherein the inner and outer edges of each sheet are annular and concentric with the annular corrugations.

* * * * *